US008783567B2

(12) United States Patent
Ranat et al.

(10) Patent No.: US 8,783,567 B2
(45) Date of Patent: Jul. 22, 2014

(54) SYSTEM INTEGRATION FOR FEASIBILITY DISPLAY

(75) Inventors: Bhadrayu Manherlal Ranat, Warton (GB); Monadl Abd Al-Abbas Mansour Al-Ameri, Warton (GB); Jeffrey Christopher Haines, Liverpool (GB)

(73) Assignee: BAE Systems PLC (GB)

( * ) Notice: Subject to any disclaimer, the term of this patent is extended or adjusted under 35 U.S.C. 154(b) by 185 days.

(21) Appl. No.: 13/389,979

(22) PCT Filed: Aug. 10, 2010

(86) PCT No.: PCT/GB2010/051323

§ 371 (c)(1),
(2), (4) Date: May 29, 2012

(87) PCT Pub. No.: WO2011/018656

PCT Pub. Date: Feb. 17, 2011

(65) Prior Publication Data

US 2012/0228379 A1 Sep. 13, 2012

(30) Foreign Application Priority Data

Aug. 12, 2009 (EP) ..... 09251978
Aug. 12, 2009 (GB) ..... 0914109.4
Dec. 2, 2009 (GB) ..... 0921089.9

(51) Int. Cl.

| | |
|---|---|
| ***G06F 19/00*** | (2011.01) |
| ***F41G 9/00*** | (2006.01) |
| ***F41G 7/00*** | (2006.01) |
| ***F41G 3/22*** | (2006.01) |

(52) U.S. Cl.

CPC ..... *F41G 7/007* (2013.01); *F41G 9/002* (2013.01); *F41G 3/22* (2013.01)

USPC ..... 235/400; 235/403; 235/404

(58) Field of Classification Search

USPC ..... 235/400, 406, 408, 410, 405, 403, 404

See application file for complete search history.

(56) References Cited

U.S. PATENT DOCUMENTS 4,160,250 A 7/1979 Butler et al.
2002/0111720 A1 8/2002 Holst et al.

(Continued)

FOREIGN PATENT DOCUMENTS

WO WO 2007/020477 A2 2/2007

OTHER PUBLICATIONS

International Search Report (PCT/ISA/210) issued on Oct. 25, 2011, by European Patent Office as the International Searching Authority for International Application No. PCT/GB2010/051323.
European Search Report for EP 09251978 dated Jan. 8, 2010.
United Kingdom Search Report for GB 0914109.4 dated Dec. 14, 2009.

(Continued)

*Primary Examiner* — Sonji Johnson
(74) *Attorney, Agent, or Firm* — Maine Cernota & Rardin

(57) ABSTRACT

Systems and methods of integrating weapons systems with the aircraft systems of an aircraft carrying the weapon so as to generate on the aircraft in flight a display indicative of the weapon successfully engaging a target are disclosed. The system can include a ground station for generating a database describing the weapon performance envelope, a generator for creating coefficients characteristic of that performance envelope using a generic algorithm and an uploader for uploading the coefficients to the aircraft, and a reconstructor on the aircraft containing the same generic algorithm and adapted to select the coefficients for the algorithm according to the aircraft and target conditions in order to generate the feasibility display, wherein the algorithm is generic to both air to ground and air to air weapons.

13 Claims, 4 Drawing Sheets

(56) References Cited

U.S. PATENT DOCUMENTS

| | | | |
|---|---|---|---|
| 2004/0015273 | A1 | 1/2004 | Leonard et al. |
| 2007/0027589 | A1 | 2/2007 | Brinkley et al. |
| 2009/0173789 | A1 | 7/2009 | Howard |

OTHER PUBLICATIONS

D. Clark et al., "Common Launch Acceptability Region Task Group", SAE World Aviation Congress—Proceedings of the 2001 Aerospace Congress, Oct. 14, 2001, pp. 1-10.

A. Singh et al., "Launch Envelope Optimization of Virtual Sliding Target Guidance Scheme", IEEE Transactions on Aerospace and Electronic Systems, Jul. 1, 2009, pp. 899-918, vol. 43, No. 3.

SYSTEM INTEGRATION FOR FEASIBILITY DISPLAY

RELATED APPLICATIONS

This application is a national phase application filed under 35 USC §371 of PCT Application No. PCT/GB10/51323 with an International filing date of Aug. 10, 2010 which claims priority of EP Patent Application 09251978.4 filed Aug. 12, 2009, GB Patent Application 0914109.4 filed Aug. 12, 2009, and GB Patent Application 0921089.9 filed Dec. 2, 2009. Each of these applications is herein incorporated by reference in their entirety for all purposes.

FIELD OF THE INVENTION

This invention relates to the integration of systems and, more particularly, to the integration of weapons on complex, highly integrated aircraft.

BACKGROUND OF THE INVENTION

Integration of a weapon system with the other systems on an aircraft is a complex and lengthy task, as it affects all the major aircraft systems. Accordingly there is a requirement to improve weapon integration time and affordability.

One of the requirements of weapon integration is to enable the display of information to the aircraft pilot as to whether or not a weapon is capable of successfully engaging a particular target. For this purpose, weapons are usually grouped into two categories, weapons designed to engage targets on the ground (air to ground weapons) and weapons designed to engage targets in the air (air to air weapons). In the case of air to ground weapons, a Launch Acceptability Region (LAR) is calculated, being the region where the probability of successfully engaging or hitting a selected target is above some threshold value. The LAR is calculated in order to provide cockpit displays in the launch aircraft indicating the feasibility of successfully engaging the target, and is a function of the weapon performance characteristics, the relative positions and motions of the aircraft and the target, and often ambient conditions such as wind speed and direction.

For an air to air weapon, a Launch Success Zone (LSZ) is calculated, indicative of the probability of successfully engaging a selected air target is about some threshold value. Again the LSZ is used to provide a cockpit display indicating whether the weapon is capable of successfully engaging the target. However, calculation of a LSZ is more complicated than the calculation of a LAR, because the relative speeds and directions of travel of the launch aircraft and the target are much greater, and consequently the effects of ambient conditions are greater, and also the physical properties of the weapons in flight are more significant on the calculation.

The conventional approach has been to create a simple, abstract model of the weapon, which is modified according to the launch conditions (taking into account the aircraft and target conditions (e.g. range, direction and speed of travel, etc.) and the ambient conditions). The model is used on board the aircraft to generate the LAR or LSZ for display to the pilot. A disadvantage of the conventional approach is that each model, for each different weapon type, is different. Storing the data relating to several different implicit models consumes significant storage capacity, and each model has to be comprehensively integrated to ensure that there is no adverse effect on any of the aircraft systems. Further, if there are any changes or modifications made to a weapon (such as an improvement in performance) or if it is necessary to load the aircraft with a completely new weapon, a lengthy and expensive integration process has to be conducted because the weapon model is substantially different to anything previously integrated with the aircraft systems.

SUMMARY OF THE INVENTION

Accordingly, the present invention provides a system for generating in an aircraft in flight a display indicative of the feasibility of a weapon carried on the aircraft successfully engaging a determined target, the system comprising a first generator, which may be a ground station, for generating a database describing the weapon performance envelope, a second generator for creating coefficients characteristic of that performance envelope using a generic algorithm and means for uploading the coefficients to the aircraft, and a reconstructor on the aircraft containing the same generic algorithm and adapted to select the coefficients for the algorithm according to the aircraft and target conditions in order to generate the feasibility display, wherein the algorithm is generic to both air to ground and air to air weapons.

Such a system significantly improves weapon integration time and cost. A minimal number of generic weapon aiming algorithms are required in order to take account of all weapon types (air to air and air to surface, and powered or unpowered). The generic algorithms can be tailored to different weapons, depending on the weapon aiming methodology adopted, simply by changing the coefficients used in the algorithm. The coefficient can be implemented as loadable data so as to allow accurate and precise weapon behaviour to be implemented within the weapon system. Also, using one or only a few generic algorithms would allow different weapon systems to be cleared or certificated/qualified for use with the aircraft with reduced effort and more quickly than with the extensive testing which is required with conventional approaches. The use of generic algorithms for weapon aiming also enables increases or significant changes in weapon system capability to be integrated with the aircraft systems with significantly less effort then heretofore.

Preferably the algorithm is a standard polynomial of the form:

$$y_n = \sum_{m=1}^{M_n} \alpha_{mn} x_1^{p1mn} x_2^{p2mn} \ldots$$

where:

$\alpha_{mn}$ represent the m coefficients required to compute output n;

$\{x_1 \ldots x_{Ni}\}$ represent the normalised inputs; and $\{y_1 \ldots y_{Nj}\}$ represent the outputs.

The invention also provides, in a second aspect, a method for generating in an aircraft in flight a display indicative of the feasibility of a weapon carried on the aircraft successfully engaging a determined target comprising:

generating a database describing the weapon performance envelope;

creating coefficients characteristic of that performance envelope using a generic algorithm;

uploading to the aircraft the generated coefficients; and reconstructing on the aircraft the performance envelope using the same generic algorithm and, according to the aircraft and target conditions and the performance envelope, generating the feasibility display, wherein the algorithm is generic to both air to ground and air to air weapons.

The aircraft and target conditions may include one or more of their relative positions, distances, directions of movement, speeds and ambient atmospheric conditions.

The coefficients specific to a weapon are preferably uploaded to the aircraft when the weapon is loaded as a weapon store. All that is required when loading a new weapon store to integrate the weapon and aircraft aiming system is at the same time to load the coefficients associated with that weapon into the aircraft system; ideally the coefficient could be stored on a hardware device with the weapon, and the devise connected to the aircraft to upload the coefficient data as the weapon is loaded.

The database may be generated by defining the range of conditions for which the weapon may be required to be fired, the range of aircraft conditions for which it is feasible for the aircraft to fire the weapon and the range of weapon conditions for which it is feasible to fire the weapon;

generating data indicative of the weapon performance for each weapon firing possibility from within the defined ranges, and creating a database defining the weapon's overall performance envelope.

In this way the database can be generated on a ground-based system, so that the aircraft system needs the capacity only to store the algorithm and process the coefficients with the aircraft and target conditions in order to generate the feasibility display, thus reducing the amount of data storage/processing capacity required on the aircraft.

The method may also comprise inputting into the reconstructor coefficients characteristic of the performance envelope of a weapon carried by another aircraft, reconstructing that performance envelope using the generic algorithm and, according to the conditions of both aircraft and the performance envelope, generating a display indicating the feasibility of the aircraft being successfully engaged by the weapon on the other aircraft.

In this way, the same aircraft system can also display whether or not, or to what extent, the aircraft is at risk of being successfully engaged by a weapon carried by a hostile aircraft, which may be a hostile aircraft which the host aircraft is deciding whether or not to engage. The generic algorithm enables the calculation of opposing LSZs and allows better assessment of air to air engagements. This in turn could lead to confident predictions of advantage and likely outcome of engagements.

The invention also encompasses an aircraft comprising the above described systems and methods.

BRIEF DESCRIPTION OF THE DRAWINGS

An embodiment of the invention will now be described by way of example and with reference to the accompanying drawings, in which.

DETAILED DESCRIPTION

Figure 1A:
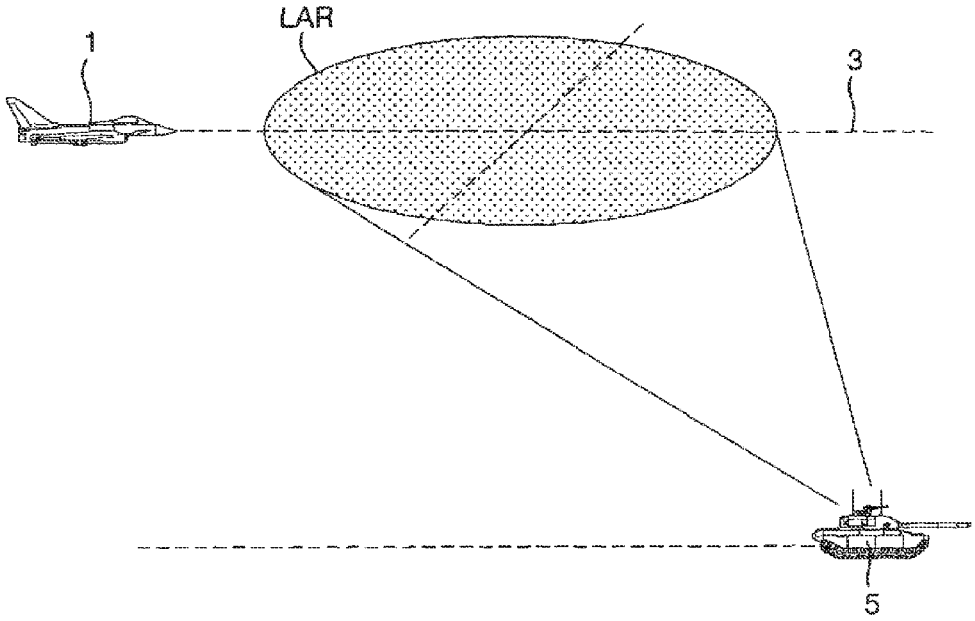
FIGS. 1*a* and 1*b* illustrate the Launch Acceptability Region (LAR) for an air to surface weapon.
Figure 1B:
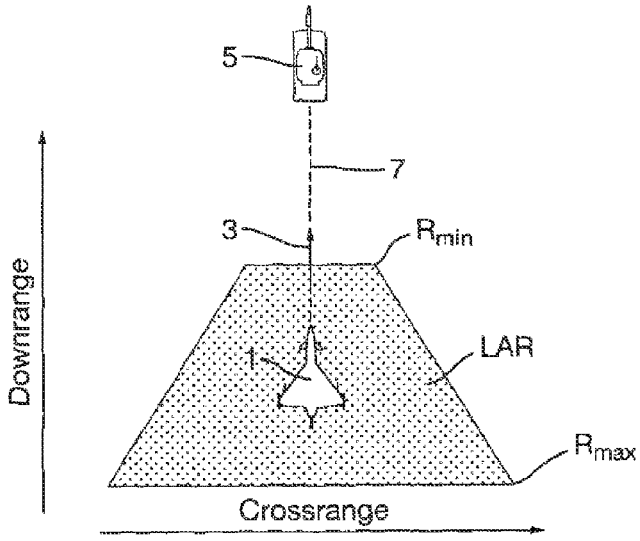

FIG. 1*a* shows the LAR in the plane of flight of a launch aircraft 1 flying along a flight path 3 in respect of a target 5 for an air to surface weapon (not shown) loaded on the aircraft. The LAR is calculated to provide cockpit displays in the launch aircraft 1 concerning the feasibility and firing opportunities for the situation. FIG. 1*b* shows the display generated for the LAR of FIG. 1*a*, which is in the form of a downrange and cross range display (the shaded area), where the weapon flight path 7 coincides with the aircraft flight path 3; to successfully engage the target 5 as shown in the display, the target must fall inside the shaded LAR. As the aircraft 1 moves in the downrange direction, the displayed LAR is bounded by the minimum and maximum ranges, $R_{min}$ and $R_{max}$.

Figure 2:
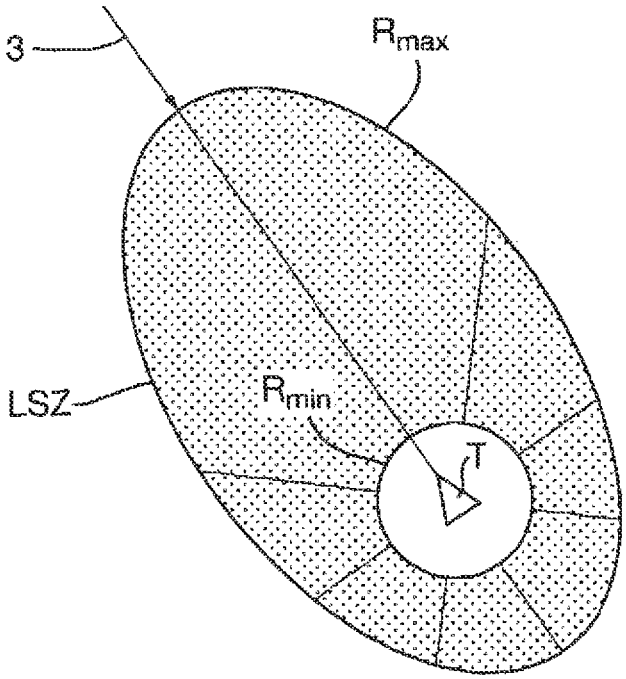
FIG. 2 illustrates the Launch Success Zone (LSZ) for an air to air weapon.

The LSZ shown in FIG. 2 is the region where the probability of an air to air weapon hitting an airborne target T is above a threshold level. Calculation of the LSZ is more complicated than for the LAR, because a greater number of factors are involved, such as the relative velocities and directions of travel of the launch aircraft and the target, and those of the weapon relative to the target. Also, the shape of the LSZ is more complex than that of the LAR; as with the LAR, there are maximum and minimum ranges, $R_{max}$ and $R_{min}$, between which the target T can be successfully engaged, but there is a zone bounded by $R_{min}$ within which the Target T cannot be engaged successfully because it is outside the capability of the weapon to manoeuvre and hit the target when the launch aircraft is so close to the target, given the speeds and directions of travel of the launch aircraft and the target T.

As is known in the art, there are two LSZs, one for the launch aircraft to engage the target 7 and the other for the target to engage the launch aircraft.

It is often a requirement to calculate the LAR or LSZ for an engagement to display to the crew of the launch aircraft information regarding the feasibility, or likelihood of success, of the engagement, and to aid fire control and steering decisions. The traditional approach has been to create a simple, abstract model of the weapon that has parameters defined by the launch conditions; this model is then used on board the launch aircraft to generate the LAR or LSZ and the appropriate display.

Figure 3:
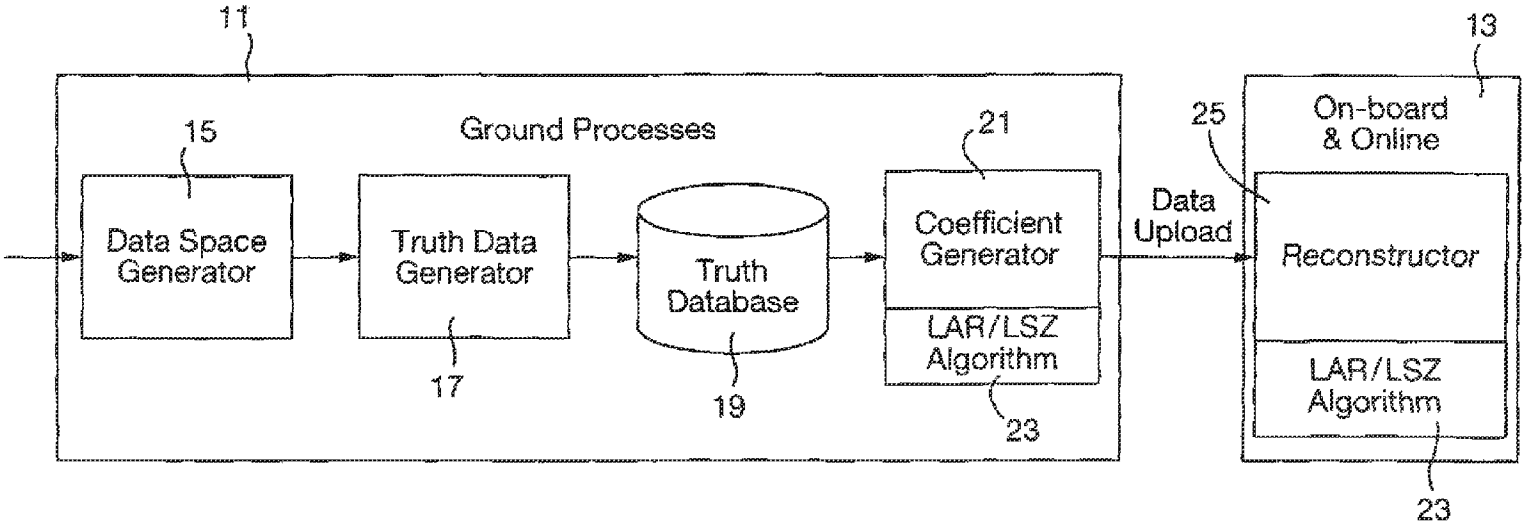
FIG. 3 is a schematic illustration of an embodiment of the present invention.

FIG. 3 shows the system of the present invention schematically, and is divided between those processes 11 which are carried out on the ground and the processes 13 which are carried out on the launch aircraft. The processes begin with the generation of the data space, which is the range of conditions over which the weapon performance envelope is to be defined; this is effected by a data space generator 15, and depends on the ranges of conditions: for which it is required to fire the weapon (which is defined by the weapon user/operator); for which it is feasible to fire according to the launch aircraft capability, and for which it is feasible to fire according to the weapon capability/performance. The data space generator 15 defines the release, weather and commanded impact conditions for training and verification sets which are run by a truth data generator 17. The truth data generator 17 generates the weapon performance for each firing case in the data space; this depends on the weapon performance model which is usually provided by the weapon manufacturer. The product of the truth data generator 17 is the truth database 19, which is a set of data relating to a number of exemplary weapon firings which is sufficient to define the weapon's performance envelope. The truth data generator 17 produces the training and verification sets which are used by a coefficient generator 21. Conventionally, the truth database is used as a model which can be employed onboard the launch aircraft in order to generate the feasibility of engagement displays (LAR or LSZ, as appropriate).

In the present invention a coefficient generator 21 receives the true weapon performance envelope represented by the truth database and calculates and generates coefficients according to a generic LAR/LSZ algorithm 23—the coefficients "fit" the generic algorithm to the weapon performance envelope shape.

The coefficient generator 21 may generate coefficients by building training and verification footprints (representing the target engagement envelope) from data extracted from the truth database, by fitting a geometric shape to the training footprint and by defining the coefficients for the generic algorithm. The coefficient generator then verifies the coefficients against the verification sets by creating footprints based on the coefficients at the verification set conditions and by confirming that these verification footprints meet the criteria for successful engagement.

Figure 4:
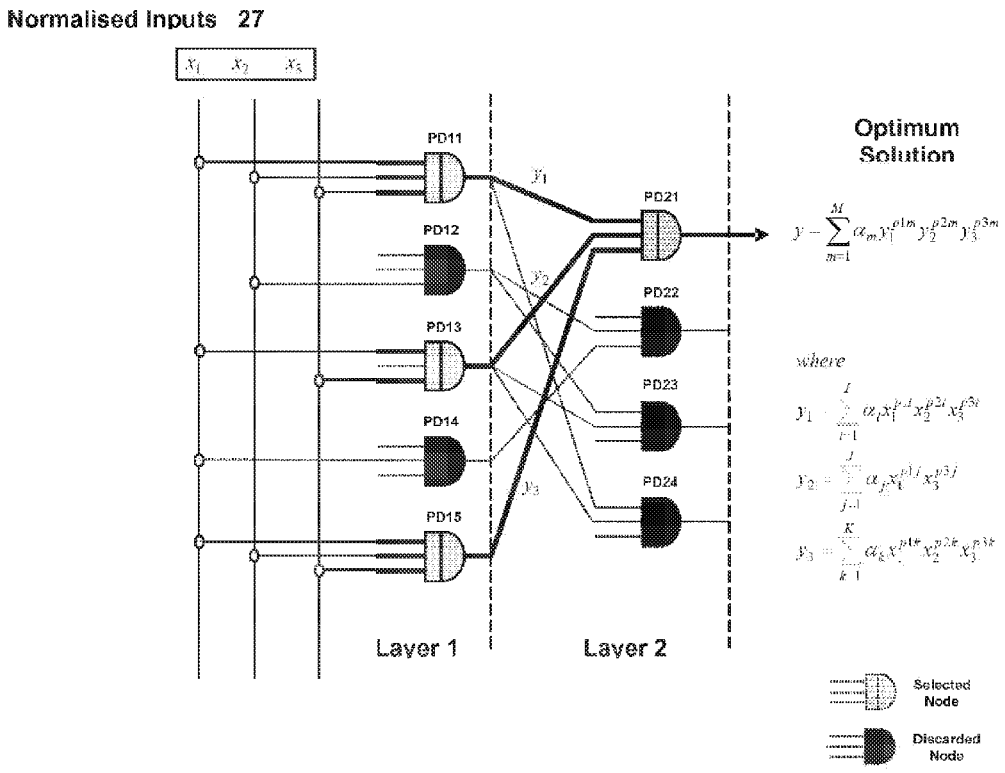
FIG. 4 is a schematic diagram illustrating one embodiment of the coefficient generator technique in accordance with the invention.

In an alternative method of coefficient generation, illustrated in FIG. 4, the number of inputs 27 and the form of each polynomial descriptor, $PD^{Layer,\ Node}$, are determined by an optimisation method known as the Genetic Algorithm. In this method the coefficient generator starts by creating an initial set of candidate polynomials whose variables are some or all of the weapon or aircraft firing condition parameters. For each candidate polynomial, the set of coefficients are computed that give the best "fit" to a single characteristic of the required LAR/LSZ using the criterion of least square error; also computed is the quality of the fit in each case, the latter referred to as the candidate "score".

The Genetic Algorithm is applied to the candidate polynomials and scores. The best polynomials are retained and the worst rejected. New candidates that have similar features to the retained candidates are created to replace the rejected ones. The coefficients giving the least squares fit and the scores are then calculated for this new generation of candidates.

The Genetic Algorithm is repeated until improvement in the scores of the best candidates ceases. The result is the first layer, Layer 1, of a Self-Organising Polynomial Neural Network (SOPNN) where each node describes a polynomial function that relates the weapon or aircraft firing condition parameters to a characteristic of the required LAR/LSZ.

The whole process is then repeated with the outputs of the first layer providing the inputs to create a second layer, Layer 2, of the SOPNN. The new layer has the effect of creating higher-order candidate polynomials and coefficients for consideration. The selection of polynomials in the new layer is again governed and optimised by the Genetic Algorithm.

Layers are added to the SOPNN in this way until improvement in the scores of the best candidates ceases—a completed network comprising two layers is represented in FIG. 4. The final network is obtained recursively from the path ending at the output node with the best score in the final generation of candidates (the "Optimum Solution"). Any node with no connection to this path is discarded as shown in FIG. 4, where nodes which contribute to the optimal solution are lightly shaded and discarded nodes are black.

The best single candidate polynomial and coefficient set is identified and stored. This process is repeated until all the required characteristics of the LAR/LSZ have corresponding polynomial models.

The generic LAR/LSZ algorithm is predetermined, and in the present invention is a polynomial equation of the form:

$$y_n = \sum_{m=1}^{M_n} \alpha_{mn} x_1^{p1mn} x_2^{p2mn} \ldots$$

Where:

$\alpha_{mn}$ represent the m coefficients required to compute output n;

$\{x_1 \ldots x_{Ni}\}$ represent the normalised inputs; and $\{y_1 \ldots y_{Nj}\}$ represent the outputs.

Referring again to FIG. 3, the output of the coefficient generator 21 is the set of coefficients which is loaded onto the launch aircraft by a data uploader. Following this step, the onboard processes 13 comprises a reconstructor 25, which brings together the generic LAR/LSZ algorithm 23 (which is held in the aircraft systems) and the uploaded coefficients, so as to reconstruct the LAR or LSZ for a particular engagement by selecting the appropriate algorithm and coefficients for the launch conditions. In the present invention, a single algorithm allows the rapid change between different weapons payloads simply by uploading a set of data representing the coefficients applicable to the new weapon. Once the LAR or LSZ has been reconstructed for a particular engagement by the systems onboard the aircraft, the LAR or LSZ is displayed by conventional means onboard the aircraft.

What is claimed is:

1. A system for generating, in a first aircraft in flight, a display indicative of feasibility of a weapon carried on the first aircraft or a second aircraft, respectively, successfully engaging the second or the first aircraft, respectively, the system comprising:

a display screen for displaying the display indicative of the feasibility of the weapon;

a first generator for generating a database describing a performance envelope of the weapon, the database stored on a non-transitory storage medium;

a second generator for creating coefficients characteristic of the performance envelope by:

a) generating candidate polynomials having a form of a generic algorithm, variables of the polynomials being some or all of a group of weapon or aircraft firing condition parameters;

b) for each candidate polynomial, computing coefficients for that candidate polynomial which best fit that candidate polynomial to the performance envelope of the weapon using a criterion of least square error;

c) for each candidate polynomial, generating a candidate score according to quality of fit of that candidate polynomial to the performance envelope of the weapon; and d) applying a genetic algorithm to the candidate polynomials and scores including selecting best scoring polynomials and discarding other polynomial(s);

an uploader for uploading the coefficients to the first aircraft; and a reconstructor on the first aircraft containing the generic algorithm and configured to select the coefficients for the generic algorithm according to conditions of the first aircraft and the second aircraft and, using the selected coefficients, generate the feasibility display.

2. A system according to claim 1, wherein the first generator is a ground station.

3. A system according to claim 2, wherein the generic algorithm is a polynomial of the form:

$$y_n = \sum_{m=1}^{M_n} \alpha_{mn} x_1^{p1mn} x_2^{p2mn} \ldots$$

where:

$\alpha_{mn}$ represent m coefficients to compute output n;

$\{x_1 \ldots x_{Ni}\}$ represent normalised inputs; and $\{y_1 \ldots y_{Nj}\}$ represent outputs.

4. A method for generating, in a first aircraft in flight, a display indicative of feasibility of a weapon carried on the first or a second aircraft, respectively, successfully engaging the second or the first aircraft, respectively, the method comprising:

generating a database describing a performance envelope of the weapon;

storing the database on a non-transitory storage medium;

creating coefficients characteristic of that performance envelope by:

a) generating candidate polynomials having a form of a generic algorithm, variables of the polynomials being some or all of a group of weapon or aircraft firing condition parameters;

b) for each candidate polynomial, computing coefficients for that candidate polynomial which best fit that candidate polynomial to the performance envelope of the weapon using a criterion of least square error;

c) for each candidate polynomial, generating a candidate score according to quality of fit of that candidate polynomial to the performance envelope of the weapon; and d) applying a genetic algorithm to the candidate polynomials and scores including selecting best scoring polynomials and discarding other polynomial(s);

uploading, to the first aircraft, the generated coefficients;

selecting, by a reconstructor on the first aircraft containing the generic algorithm, the coefficients for the generic algorithm according to conditions of the first aircraft and the second aircraft;

generating, by the reconstructor using the selected coefficients, the feasibility display; and displaying, on a display screen, the feasibility display.

5. A system according to claim 4, wherein the coefficient generator is configured for:

generating new polynomials to replace those discarded, and repeating steps b) and c) until there is no further significant improvement in candidate scores.

6. A system according to claim 5, wherein outputs of the selected polynomials are used to provide inputs so as to create higher order candidate polynomials.

7. A system according to claim 6, wherein the coefficient generator is configured for:

iterating generation of a candidate score on the higher order candidate polynomials, and obtaining a final result recursively from a path ending with a best candidate score.

8. A method according to claim 4, wherein the generic algorithm is a polynomial of the form:

$$y_n = \sum_{m=1}^{M_n} \alpha_{mn} x_1^{p1mn} x_2^{p2mn} \ldots$$

where:

$\alpha_{mn}$ represent m coefficients to compute output n;

$\{x_1 \ldots x_{Ni}\}$ represent normalised inputs; and $\{y_1 \ldots y_{Nj}\}$ represent outputs.

9. A method according to claim 4, wherein the aircraft conditions include one or more of their relative positions, distances, directions of movement, speeds and ambient atmospheric conditions.

10. A method according to claim 4, wherein coefficients specific to a weapon are uploaded to the first aircraft when the weapon is loaded as an aircraft store.

11. A method according to claim 4, wherein the database is generated by:

defining a range of conditions for which a weapon may be fired, a range of aircraft conditions for which it is feasible for the aircraft to fire the weapon and a range of weapon conditions for which it is feasible to fire the weapon;

generating data indicative of weapon performance for each weapon firing possibility from within the defined ranges; and creating a database defining a weapon's overall performance envelope.

12. An aircraft comprising:

a reconstructor configured to match coefficients characteristic of a weapon carried by the aircraft or a second aircraft and uploaded to the aircraft with a generic algorithm according to conditions of the aircraft and the second aircraft, in order to generate a display indicative of feasibility of the weapon successfully engaging the second aircraft and a display screen for displaying the display indicative of the feasibility of the weapon;

a first generator for generating a database describing a performance envelope of the weapon, the database stored on a non-transitory storage medium;

a second generator for creating coefficients characteristic of the performance envelope by:

a) generating candidate polynomials having a form of a generic algorithm, variables of the polynomials being some or all of a group of weapon or aircraft firing condition parameters;

b) for each candidate polynomial, computing coefficients for that candidate polynomial which best fit that candidate polynomial to the performance envelope of the weapon using a criterion of least square error;

c) for each candidate polynomial, generating a candidate score according to quality of fit of that candidate polynomial to the performance envelope of the weapon; and d) applying a genetic algorithm to the candidate polynomials and scores including selecting best scoring polynomials and discarding other polynomial(s);

an uploader for uploading the coefficients to the aircraft; and a reconstructor on the aircraft containing the generic algorithm and configured to select the coefficients for the generic algorithm according to conditions of the aircraft and the second aircraft and, using the selected coefficients, generate the feasibility display.

13. An aircraft according to claim 12, wherein the generic algorithm is a polynomial of the form:

$$y_n = \sum_{m=1}^{M_n} \alpha_{mn} x_1^{p1mn} x_2^{p2mn} \ldots$$

where:

$\alpha_{mn}$ represent m coefficients to compute output n;

$\{x_1 \ldots x_{Ni}\}$ represent normalised inputs; and $\{y_1 \ldots y_{Nj}\}$ represent outputs.

* * * * *